US005863039A

United States Patent [19]

Suzuki

[11] Patent Number: 5,863,039

[45] Date of Patent: Jan. 26, 1999

[54] PAPER MONEY DEALING APPARATUS

[75] Inventor: Yasuo Suzuki, Tokyo, Japan

[73] Assignee: Universal Sales Co., Ltd., Tokyo, Japan

[21] Appl. No.: 717,018

[22] Filed: Sep. 20, 1996

[30] Foreign Application Priority Data

Sep. 26, 1995 [JP] Japan ..... 7-271734

[51] Int. Cl.[6] ..... B65H 29/44

[52] U.S. Cl. ..... 271/207; 271/180

[58] Field of Search ..... 271/181, 180, 271/219, 314, 177, 207; 194/206, 350, 207, 188; 198/218

[56] References Cited

U.S. PATENT DOCUMENTS

| | | | |
|---|---|---|---|
| 4,332,348 | 6/1982 | Nordin | 232/43.1 |
| 5,344,135 | 9/1994 | Isobe et al. | 271/180 |
| 5,388,817 | 2/1995 | Chang | 271/180 |
| 5,411,249 | 5/1995 | Zouzoulas, deceased | 271/181 |
| 5,564,545 | 10/1996 | Suzuki | 194/206 |
| 5,662,201 | 9/1997 | Gerlier et al. | 194/206 |
| 5,676,366 | 10/1997 | Polidro | 271/176 |
| 5,740,897 | 4/1998 | Gauselman | 194/206 |

FOREIGN PATENT DOCUMENTS

| | | |
|---|---|---|
| 0 700 022 | 3/1996 | European Pat. Off. . |
| 1-164586 | 11/1989 | Japan . |
| 7-330202 | 12/1995 | Japan . |
| 8-123991 | 5/1996 | Japan . |

*Primary Examiner*—William E. Terrell
*Assistant Examiner*—Kenneth W. Bowes
*Attorney, Agent, or Firm*—Pillsbury Madison & Sutro LLP

[57] ABSTRACT

A bill dealing apparatus facilitating the bill collection with less trouble in reduced size and cost. The door 22 of the bill dealing apparatus 21 is exposed on the outer surface of the front door 23 of the slot machine. Bill validator 25 is attached inside the door 22 for verifying the validity of the inserted bill 24. The stacker 26 for storing the inserted bill is housed in the body 27. The front of the body 27 is open to form an opening 27*a,* through which the stacker 26 is attached to and removed from the body 27. The door 22, which blocks the opening 27*a,* is attached to the body 27 pivotal about the support shaft 28, and opens in the direction B. The driving unit 29 is positioned behind the stacker 26 for driving the bill presser. The stacker 26 is inserted to and taken out from the body 27 independent from the driving unit 29.

15 Claims, 13 Drawing Sheets

PAPER MONEY DEALING APPARATUS

BACKGROUND OF THE INVENTION

1. Field of the Invention

This invention relates to a bill (paper money) dealing apparatus which receives and temporarily keeps bill while checking the genuineness and quality of the money.

2. Related Art

Paper money dealing apparatus has been conventionally used in various fields. One example is a built-in bill dealing apparatus fixed into a game machine. In this example, the bill dealing apparatus increases the credit point of the game machine indicative of the playable range, or returns substitute money, such as a game coin, corresponding to the amount of the inserted bill. Another example is a bill dealing apparatus built in a money changer, in which the inserted bill is changed into different types of money. Paper money dealing apparatus is also applied to vending machines, which puts out goods after money is inserted.

FIG. 1 illustrates a slot machine, as an example of the conventional game machine, showing the internal structure. The slot machine includes a bill dealing apparatus 1 fixed to the bill stand 2. When a main door 3 is closed, the bill dealing apparatus 1 is hidden behind the door, except for a bill insert opening 4.

FIGS. 2 and 3 show the structure of the conventional bill dealing apparatus 1. The bill insert opening 4 is provided in front of a bill validator 5 (FIG. 2). Money inserted through the bill insert opening 4 is checked by the bill validator 5 for the genuineness and the quality. The bill determined as valid is stacked up in a bill cassette (stacker) 6 (FIG. 3), and is temporarily stored therein. A top shutter 7 of the stacker 6 is open when the stacker 6 is housed in a body 8. The bill stored in the stacker 6 are regularly collected by removing the stacker 6 from the slot machine and carrying it to a secure place. The shutter 7 is closed when the stacker 6 is removed and transported to other place, as shown in FIG. 3.

The stacker 6 is generally taken out from the slot machine in accordance with the following steps: unlocking the key 9K of the bottom door 9 positioned at the lower portion of the main door 3 to open a bottom door 9 (as indicated by the one dot broken line in FIG. 1) while maintaining the main door 3 closed; revealing a lever 10, a handle 11 provided in front of the stacker 6 (FIG. 3), and a key hole 2*a* of the bill stand 2, which are all accommodated in the lower portion inside the slot machine, after opening the bottom door 9; inserting a key into the key hole 2*a* to unlock the bill stand 2; and rotating the handle 11 while depressing the lever 10 and pulling the stacker 6 out of the slot machine.

However, in the conventional bill dealing apparatus 1, it was cumbersome to take out the stacker 6 from the slot machine because it requires several steps of actions. The actions include unlocking and opening the bottom door 9, unlocking the key of the bill stand 2, operating the lever 10 and the handle 11, and pulling out the stacker 6. Therefore, simple removement and bill collection have been desired.

In the conventional bill dealing apparatus 1, when the bill validator 5 determines that the inserted bill is valid, the bill is pushed into the stacker 6 by a bill presser. The bill presser is generally positioned above the shutter 7 of the stacker 6 and within the body 8, being fixed to an attachment panel by, for example, a screw. The bill validator 5 is also fixed to the body 8 above the stacker 6. These components piled on the stacker 6 make the bill dealing apparatus 1 larger (in volume and height), and require large space inside the slot machine.

Furthermore, a driving unit composed of e.g., motor is generally provided inside the stacker 6 for driving the bill presser. This makes the stacker 6 heavy, which makes the work of collecting and transporting a number of stacker 6 troublesome. If the inserted bill is wet or creased, friction or resistance occurs between the bill and the feeding path, which prevents the bill from being smoothly fed to the stacker position.

SUMMARY OF THE INVENTION

The purpose of this invention is to overcome these problems and to provide a bill dealing apparatus, built in a machine, that can facilitate the bill collecting and transporting process in reduced size and weight. The bill dealing apparatus comprises a bill validator for verifying the validity of the bill inserted externally. A feeding path feeds the bill which was determined as valid by the bill validator. A bill stacker receives and stores the bill which has been fed through the bill feeding path. A body receives and houses the bill stacker which has been removably inserted. A bill presser pushes the bill into the bill stacker. A driving source drives the bill presser. The body has a door with a key, and a front opening opened and closed by the door. The door is exposed on the front surface of the machine when the money dealing apparatus is built in the equipment or machine. The bill stacker is removably attached to the body through the opening. The bill validator is attached inside the door, integral with inner plane of the door.

The Bill stacker and driving source are provided individually. Accordingly, the bill stacker is removably attached to the body separating from the driving source. The bill presser is attached to the face of a wall of the bill stacker. The bill feeding path comprises a pair of rails which come into linear contact with the edges of the bill for feeding the bill to the stacker.

When the body door is unlocked and opened, the bill stacker immediately appears at the front opening of the body and is easily removed from the equipment or machine, to which the bill dealing apparatus is fixed. This structure simplifies the bill collecting work because the step of opening the main door of the equipment or machine is eliminated. The bill validator is attached inside the body door to be positioned next to the stacker side by side. Furthermore, the bill presser is attached inside the stacker to the face of the wall of the stacker. This structure can reduce the height (size) of the bill dealing apparatus, as well as the number of the parts used therein.

The stacker and the driving source are made as separate units to reduce the size and weight of the stacker, which facilitates the transportation of the stacker. The bill feeding path supports the bill by a linear contact with the edges of the bill, thereby reducing the contact resistance between the bill and the feeding path. As a result, bill feeding trouble is greatly reduced.

Japanese patent application H07-271734, filled by the same applicant on Sep. 26, 1995, is hereby incorporated into this specification by reference.

DETAILED DESCRIPTION OF THE PREFERRED EMBODIMENT

Figure 1:
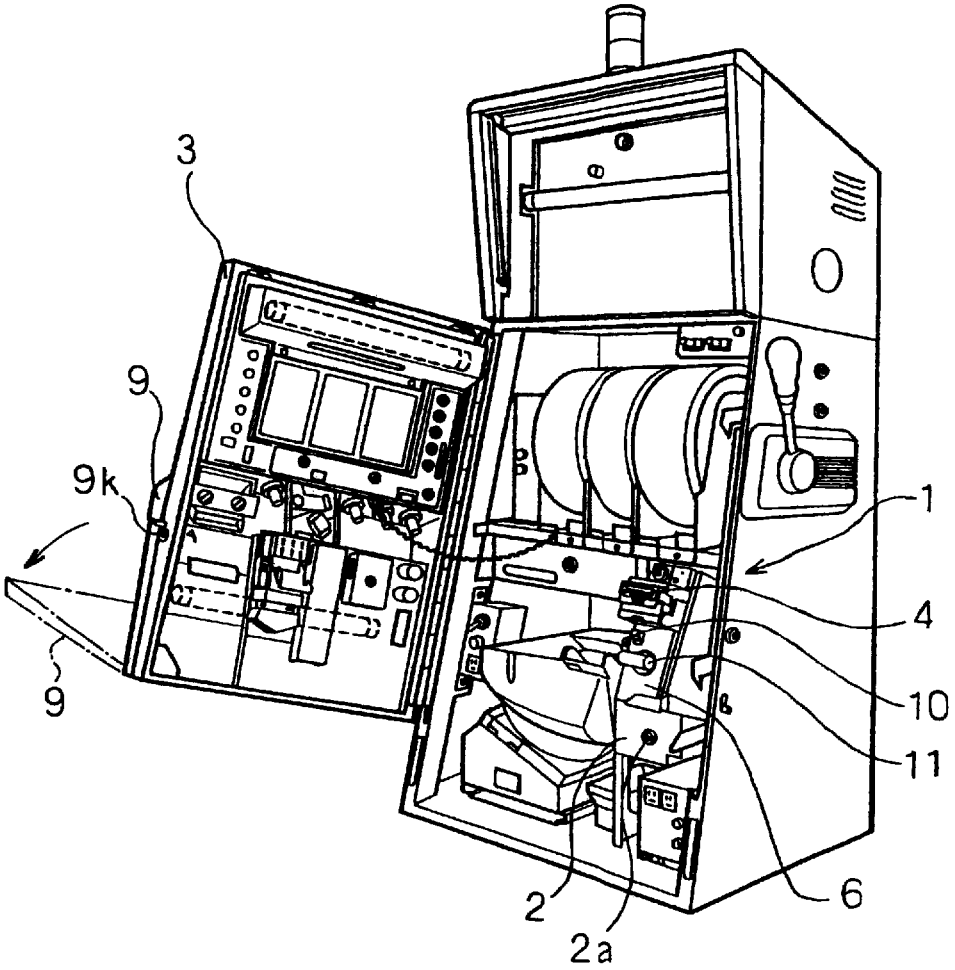
FIG. 1 is a perspective view of the slot machine, in which the conventional bill dealing apparatus is built up.
Figure 2:
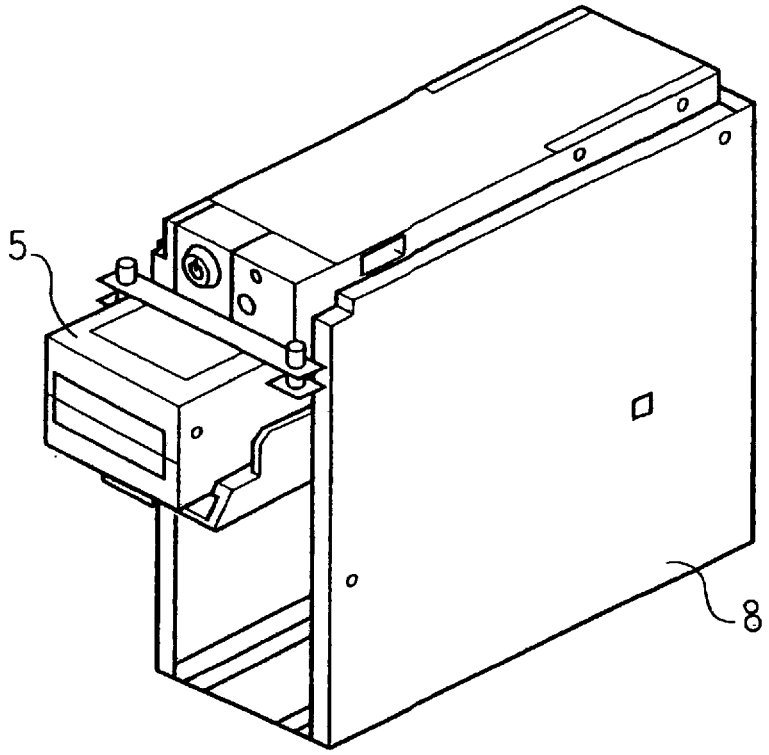
FIG. 2 is a perspective view of the body of the conventional bill dealing apparatus.
Figure 3:
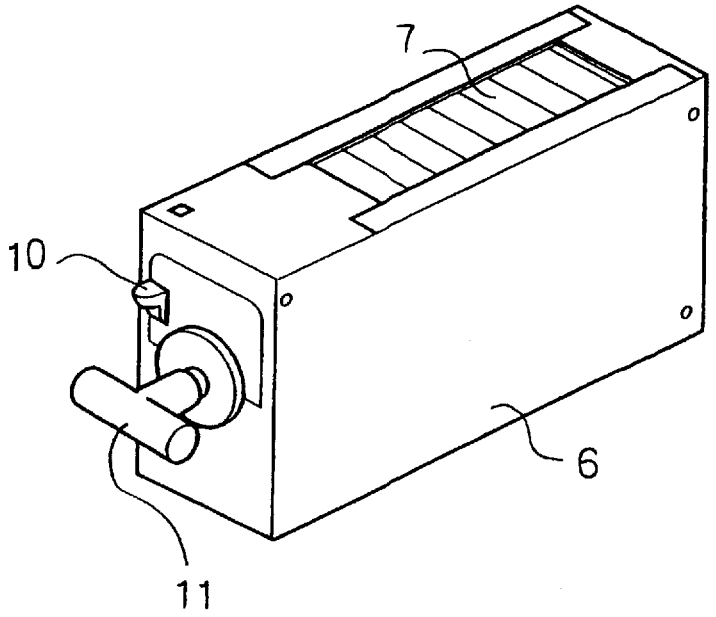
FIG. 3 is a perspective view of the bill stacker of the conventional bill dealing apparatus.
Figure 4:
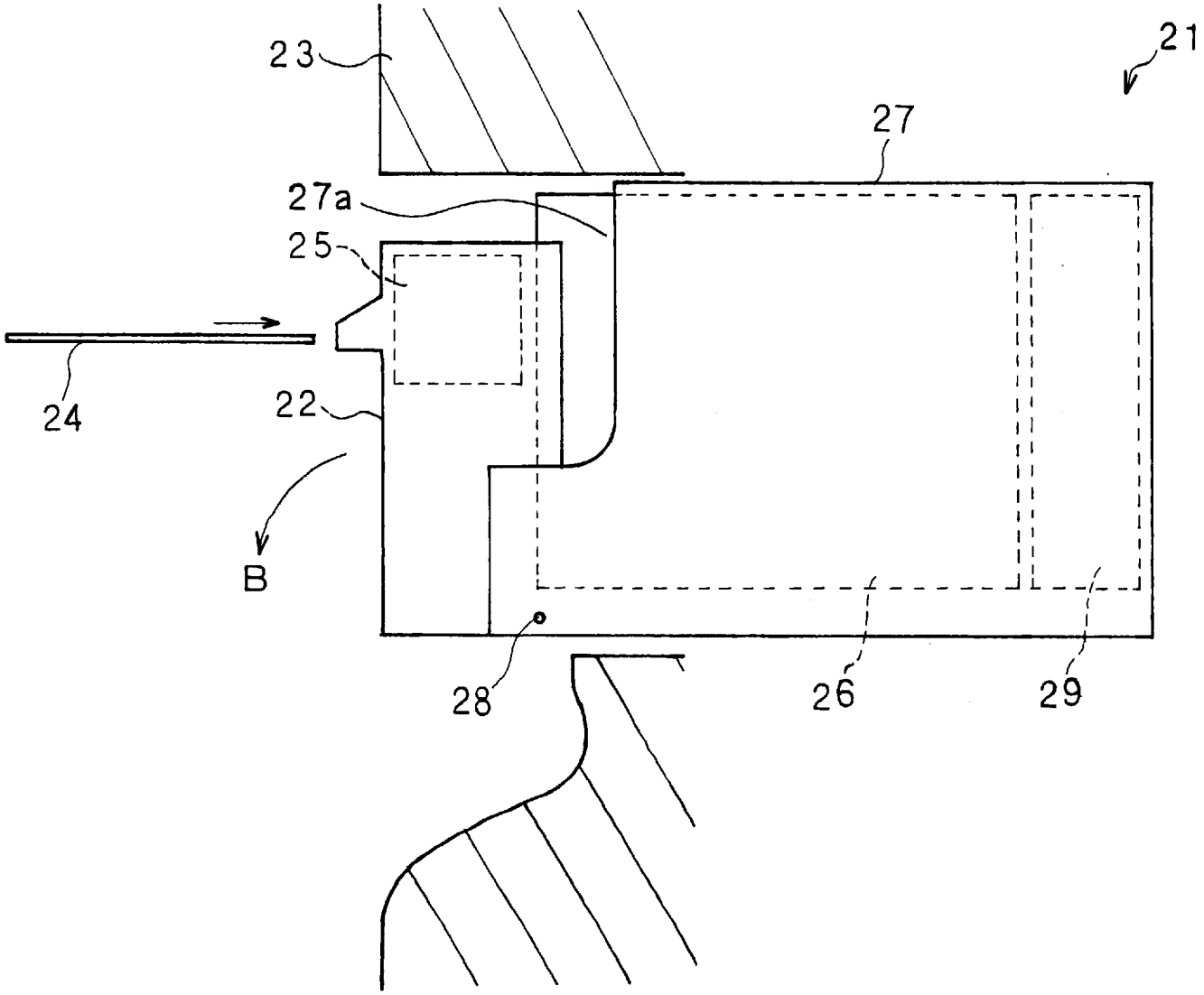
FIG. 4 is a side view conceptually showing the structure of the bill dealing apparatus according to the preferred embodiment of the invention.

FIG. 4 shows a bill dealing apparatus 21 which is built in a slot machine. The bill dealing apparatus 21 is accommodated in the slot machine so that a door 22 is exposed in alignment with the surface of a front door 23 of the slot machine. Inside the door 22, a bill validator 25 is attached for verifying the validity of a inserted bill 24. The bill 24 which was determined as valid by the bill validator 25 is stored in a stacker 26 through the bill feeding path (which will be described below). The stacker 26 is housed in a body 27. The front of the body 27 at the front door 23 side is open to form an opening 27*a,* through which the stacker 26 is removably attached to the body 27. A support shaft 28 is provided on the bottom end of the opening 27*a* to support the door 22. The door 22 is pivotal about the shaft 28 in the direction B (FIG. 4) to close and open the front opening 27*a*. A driving unit 29 for driving a bill presser is positioned inside the body 27 and behind the stacker 26. The stacker 26 and the driving unit 29 are made as separate units, and therefore, the stacker 26 is attached to and detached from the body 27 independent from the driving unit 29.

Figure 5:
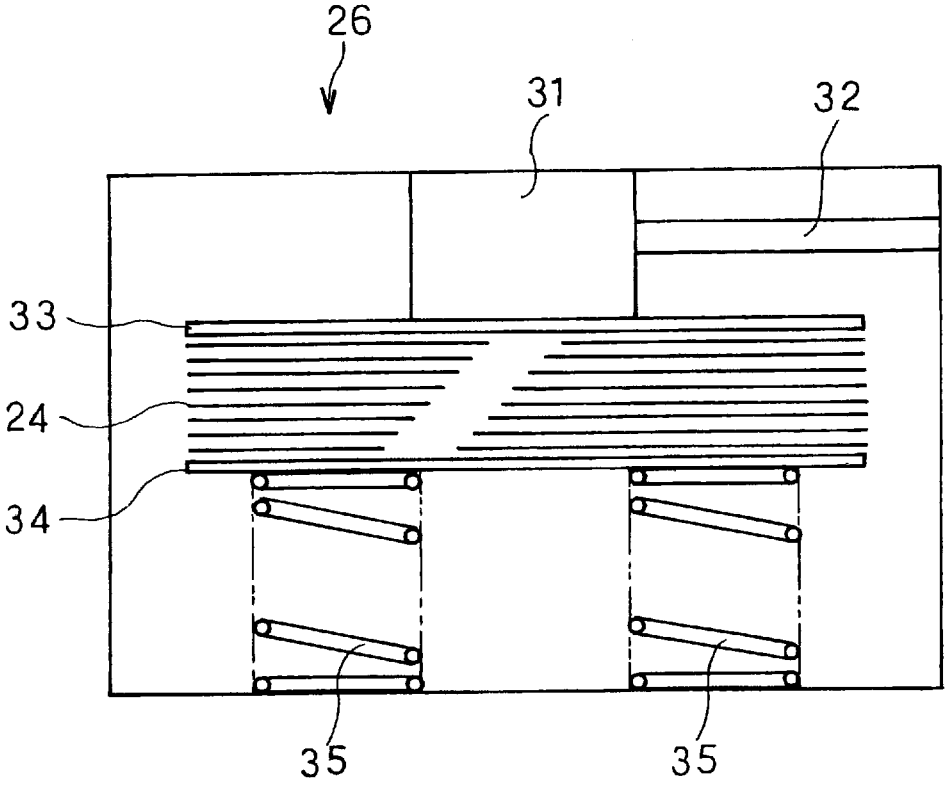
FIG. 5 is a side view conceptually showing the internal structure of the stacker.
Figure 12:
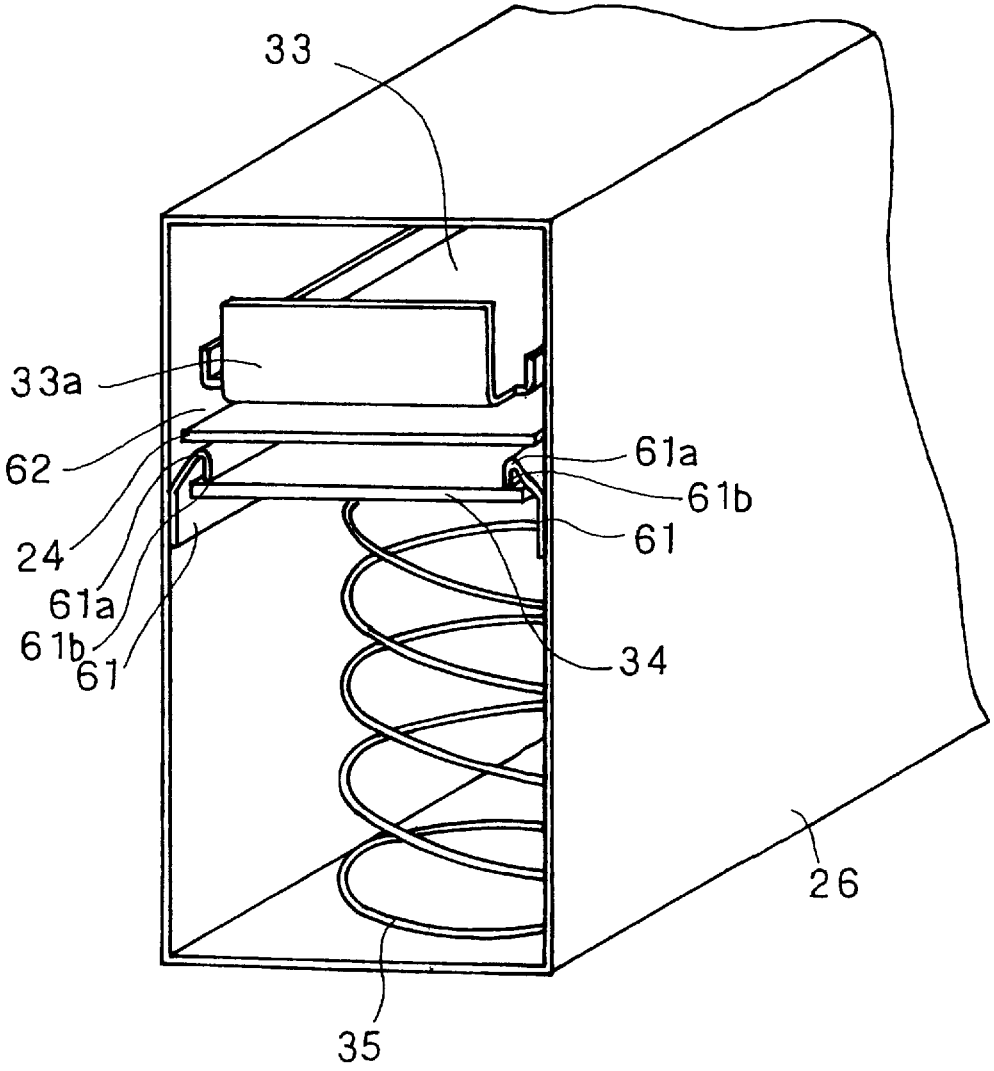
FIG. 12 shows the bill feeding path in the stacker.

FIG. 5 shows the internal structure of the stacker 26. The bill presser 31 is fixed to the face of a top inner wall of the stacker 26. The driving power is transmitted from the driving unit 29 through the shaft 32 to the bill presser 31. With the driving power, the bill presser 31 presses a pusher plate 33 downward to stack the bill 24 on a support plate 34. The support plate 34 is forced upward by compressive coil springs 35, thereby holding the inserted bill 24 between the support plate 34 and the bottom edges 61*b* of the rails 61 (see FIGS. 12 and 13).

Figure 6:
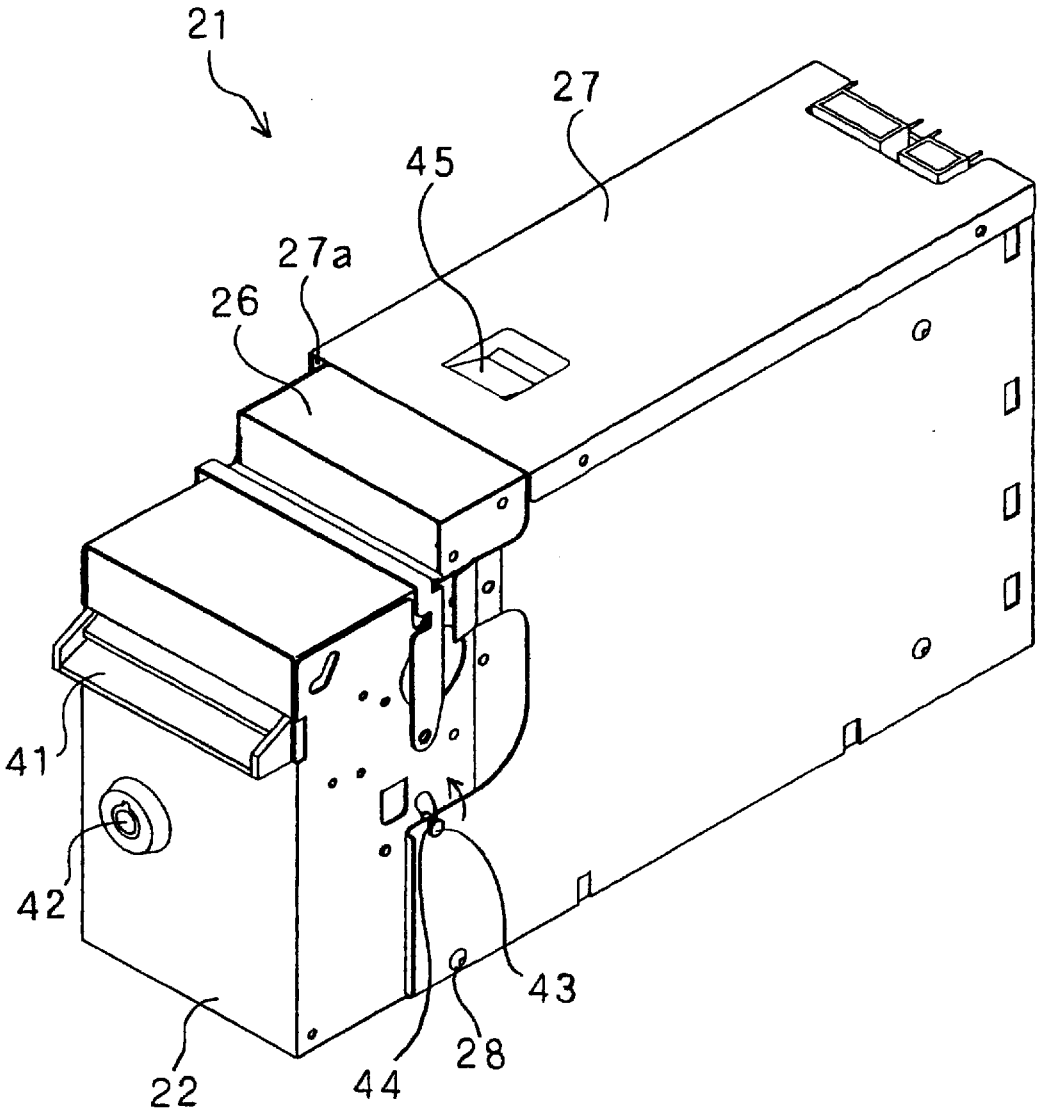
FIG. 6 is a perspective view of the bill dealing machine according to the preferred embodiment of the invention.

FIG. 6 shows an appearance of the bill dealing apparatus 21 of the preferred embodiment. A bill insert opening 41 is positioned on the upper front of the door 22, through which the bill 24 is inserted. The bill 24 inserted through the opening 41 is guided to the bill validator 25. The door 22 has a key hole 42. If a key is inserted into the key hole 42 and turned, then a lock stick 43, which penetrates the door 22, moves in the arc in the direction of the arrow. In the locked state, both ends of the lock stick 43 are received in notches 44 to lock the door 22 which closes the front opening 27*a* of the body 27. When the door 22 is unlocked, the lock stick 43 moves in the arc in the direction of arrow in response to turning the key, whereby the door 22 is disengaged from the body 27 and pivots about the support shaft 28. As the door 22 is open, the front opening 27*a* of the body 27 is open to expose the front face of the stacker 26.

A portion of the top wall of the body 27 is cut out to provide a spring plate 45 having a resilience in the vertical direction. When the stacker 26 is inserted into the body 27, the spring plate 45 comes into contacts with the top wall of the stacker 26 and guides the stacker 26 to the right position. The spring plate 45 also absorbs dispersion or manufacturing error in the height of the stacker 26 when the stacker 26 is accommodated in the body 27.

Figure 7:
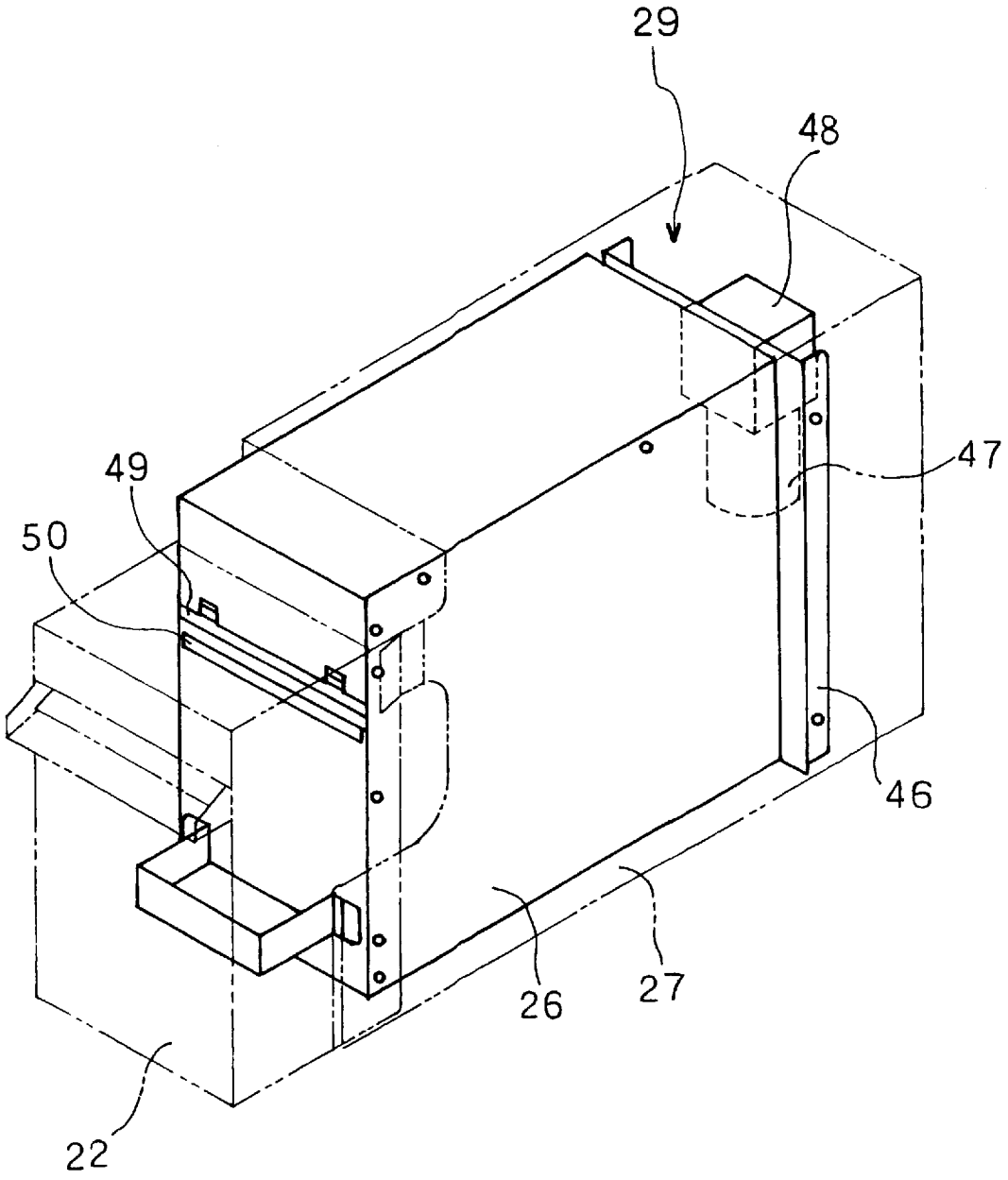
FIG. 7 is a perspective view showing the positional relationship between the stacker and the driving unit.

FIG. 7 shows positional arrangement of the stacker 26 and the driving unit 29 in the bill dealing apparatus 21 of FIG. 6. A partition 46 is provided in the body 27 at the position just behind a rear wall of the stacker 26 to divide the inner space into two sections, i.e., stacker receiving section and driving unit receiving section. A motor 47 and a decelerator (speed reducer) 48, which make up the driving unit 27, are positioned behind the partition 46. A bill receiving port 49 is provided on the front surface of the stacker 26 (on the side of door 22). The bill output from the bill validator 25 is received at the bill receiving port 49. A recess 50 is formed, extending in the horizontal direction below the bill receiving port 49.

Figure 8:
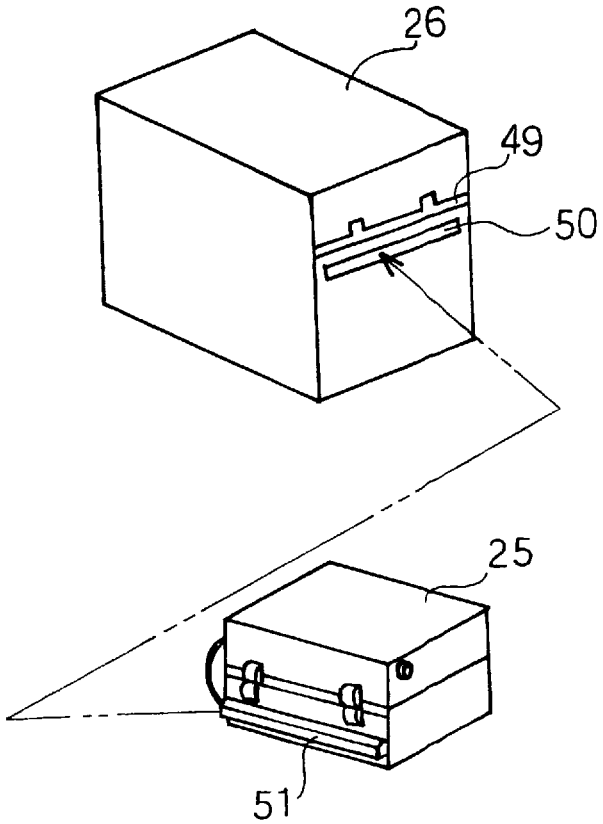
FIG. 8 shows how the bill validator is combined with the stacker.

On the other hand, as shown in FIG. 8, protrusion 51 is formed on the back of the bill validator 25, which fits in the recess 50. If the bill validator 25 is attached to the stacker 26 by fitting the projection 51 in the recess 50, then the bill receiving port 49 of the stacker 26 and a bill output port of the bill validator 25 are stably positioned both in vertical and horizontal directions. The bill output from the bill validator 25 is guided by the recess 50 and the projection 51, and is smoothly fed to the bill receiving port 49. This can prevent troubles from occurring in the bill guide path.

Figure 9:
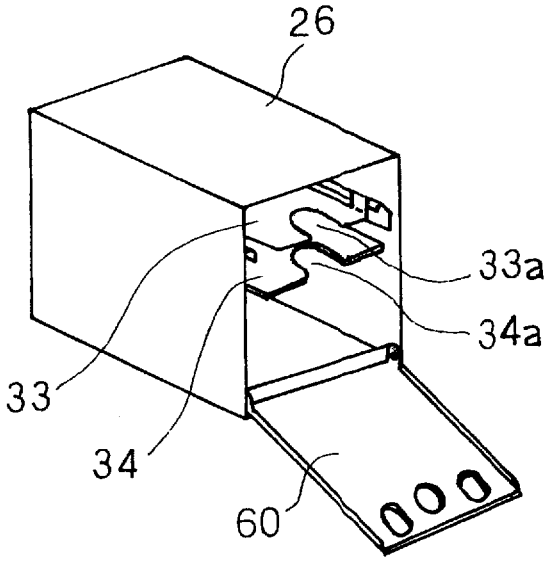
FIG. 9 shows the rear portion of the stacker.

A door 60 is provided on the back of the stacker 26, as shown in FIG. 9. The door 60 is usually closed and locked with a key (not shown). Even if the stacker 26 is removed from the body 27, the bill stored in the stacker 26 can not be taken out from the stacker 26 unless the door 60 is open. The pusher plate 33 and the support plate 34 have notches 33*a* and 34*a,* respectively, at the edges of the rear side, whereby a portion of bill is exposed by the notches and is easily gripped, so that the bill collection from the stacker 26 is facilitated.

Figure 10:
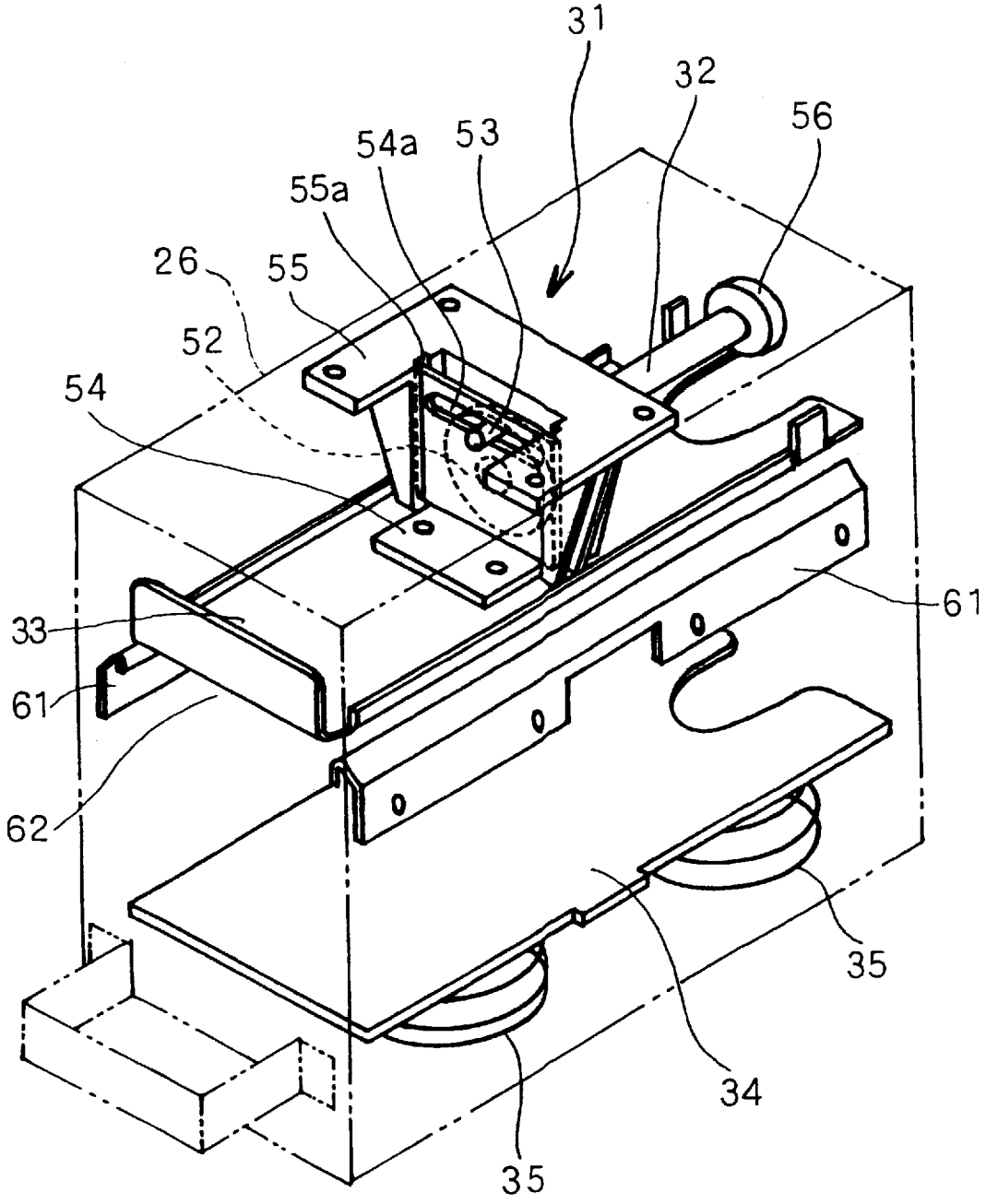
FIG. 10 is a perspective view showing the internal structure of the stacker.

FIG. 10 is a perspective view showing the internal structure of the stacker 26. The bill presser 31 is attached on the face of the upper side wall of the stacker 26, as described above. The bill presser 31 comprises a disc 52 coupled with one end of the shaft 32, an eccentric pin 53 provided on the periphery of the disc 52, a slide plate 54 bent into an L-shape, and a U-shaped support frame 55. The bottom surface of the U-shaped support frame 55 is fixed to the face of the top wall of the stacker 26. A pair of grooves 55*a* are formed on the two opposite inner side walls of the U-shaped frame 55. The root of the L-shaped slide plate 54 is fixed to the pusher plate 33, and the side edges of the standing plane of the slide plate 54 are received in the grooves 55*a* of the support frame 55 slidable in the vertical direction. The standing plane of the L-shaped slide plate 54 has a slide groove 54*a* extending in the horizontal direction, in which the columnar eccentric pin 53 is inserted. When driving force is transmitted to the shaft 32 to rotate the disc 52, the eccentric pin 53 moves up and down while sliding in the horizontal direction along the slide groove 54*a*. The up-down movement of the eccentric pin 53 makes the slide plate 54 and the pusher plate 33 fixed thereto move up and down.

Figure 11:
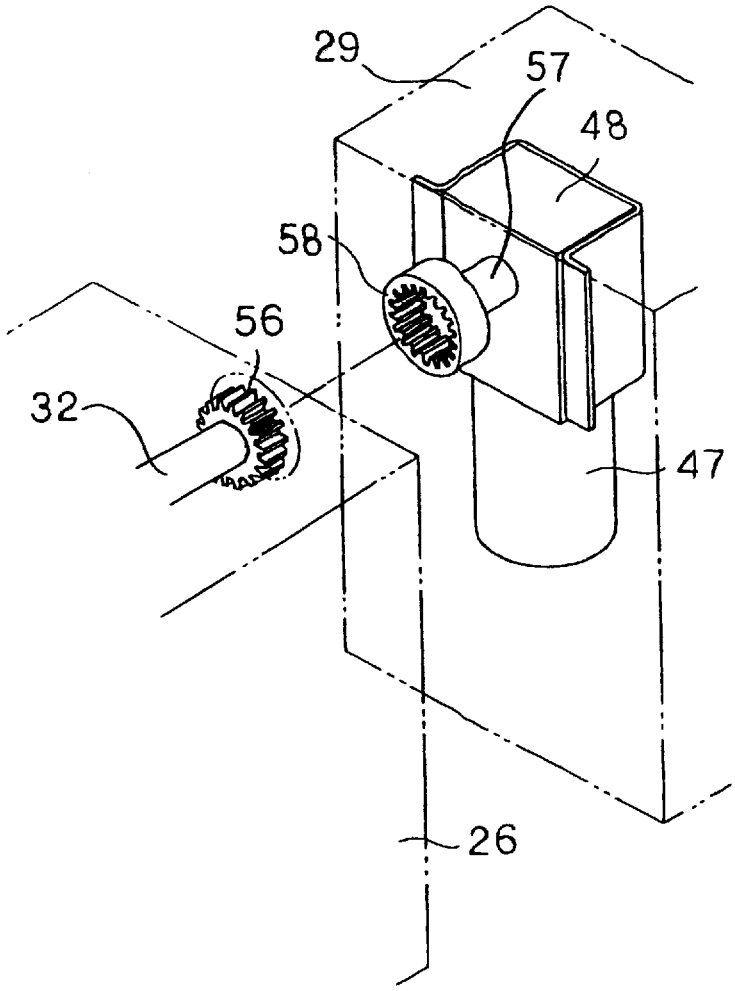
FIG. 11 shows the driving power transmission mechanism between the stacker and the driving unit.

The other end of the shaft 32 is coupled with a spline shaft 56, on which male spline teeth are formed. The spline shaft 56 is opposed to a spline bearing 58 which has female spline teeth and is positioned in the driving unit 29 (FIG. 11). The spline bearing 58 is fixed to the end of an output axis 57 of the decelerator 48. When the stacker 26 is received in the body 27, the spline shaft 56 of the stacker 26 is engaged with the spline bearing 58 of the driving unit 29. The revolution of a motor 47 is reduced by the decelerator 48 with a predetermined rate, and the motive power output from the motor 47 is transmitted to the output axis 57. The motive power is transmitted to the stacker 26 side through the spline bearing 58 and the spline shaft 56, and is finally transmitted to the disc 52 through the shaft 32.

As shown in FIG. 10, the space between the bottom of the pusher plate 33 and the rails 61 form a bill feeding path 62. An entrance port of the bill feeding path 62 is open opposite the bill receiving port 49 located on the front surface of the stacker 26. The rails 61 are composed of a pair of plate material attached to the inner side walls of the stacker 26 to be opposed to each other. One edge of each plate material is bent into a U-shape along the longitudinal direction to form a bend portion 61*a* (as can be seen from FIG. 12). The U-shaped bend portion 61*a* becomes a contact portion of the rail 61, which meets the bill 24. Either edge of the inserted bill 24 come into linear contact with the bend portion 61*a*. One end of the pusher plate 33, which is next to the bill validator 25, is bent to form a bend portion 33*a*. A leading edge of the bill 24 output from the bill validator 25 is guided by the bend portion 33*a* to the bill feeding path 62.

Before the bill 24 is stored in the stacker 26, the support plate 34 is pushed upward by the compressive coil spring 35, and side edges of the support plate 34 are pressed against the bottom edges 61*b* of the bend portions 61*a* of the rails 61. In this situation, when the pusher plate 33 is pressed downward by the bill presser 31, the pusher plate 33 descends through a space between the pair of rails 61 and meets the bill stacked on the top surface of the support plate 34. The width of the pusher plate 33 is smaller than the distance between the two rails 61. As the pusher plate 33 descends between the rails 61, a force is applied downward to the center of the bill 24. On the other hand, side edges of the bill 24 tend to go upward by the presence of rails 61. As a result, the side edges of the bill 24 is curved upward along the longitudinal axis by the pressure from the pusher plate 33. When the pusher plate 33 is further driven and has passed through between the rails 61, the side edges of the bill 24 returns with its resilience and is stacked flat on the support plate 34.

Figure 13:
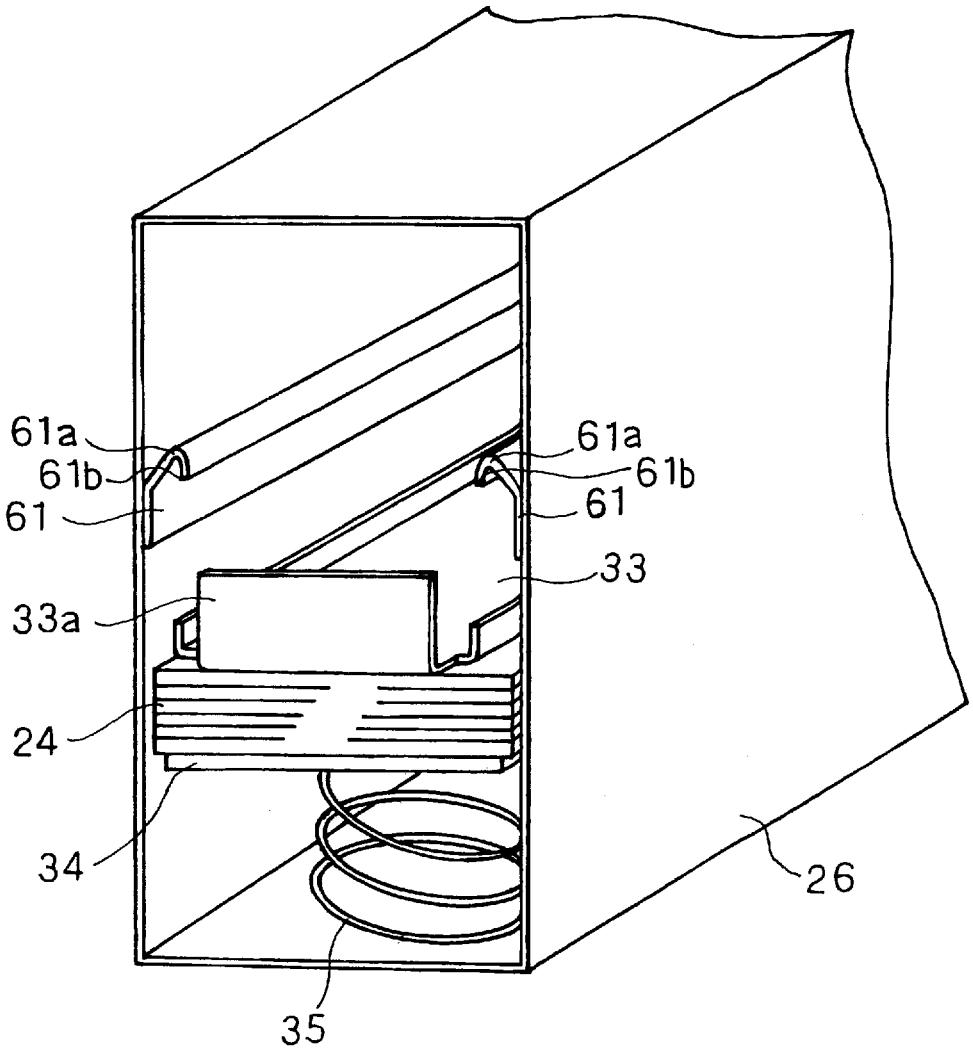
FIG. 13 shows how the inserted bill is stacked in the stacker.

When the L-shaped slide plate 54 is pulled up according to the rotation of the disc 52, the pusher plate 33 moves upward. As the pusher plate 33 goes up, the support plate 34 is pushed up by the coil spring 35, and the bill 24 is held between the support plate 34 and each of the edges 61*b* of the bend portions 61*a* of the rails 61. FIG. 13 shows the situation where the bill stack actions as described above have been repeated and bills are stacked between the pusher plate 33 and the support plate 34. When the pusher plate 33 moves upward from this situation, the stack of bills 24 is held between the support plate 34 and the respective rails 61. The same numerals are assigned to the same elements as those in FIG. 12.

How the Stacker is collected from the bill dealing apparatus 21 of the invention will be explained with reference to FIGS. 14 through 17. The same elements as FIG. 6 have the same numerals, and their explanation will be omitted.

Figure 14:
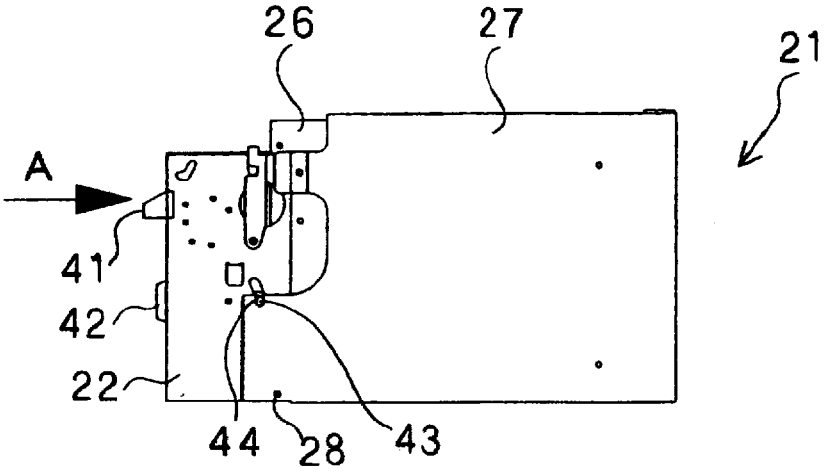
FIG. 14 is a side view of the bill dealing apparatus at the first step of the bill collection.
Figure 15:
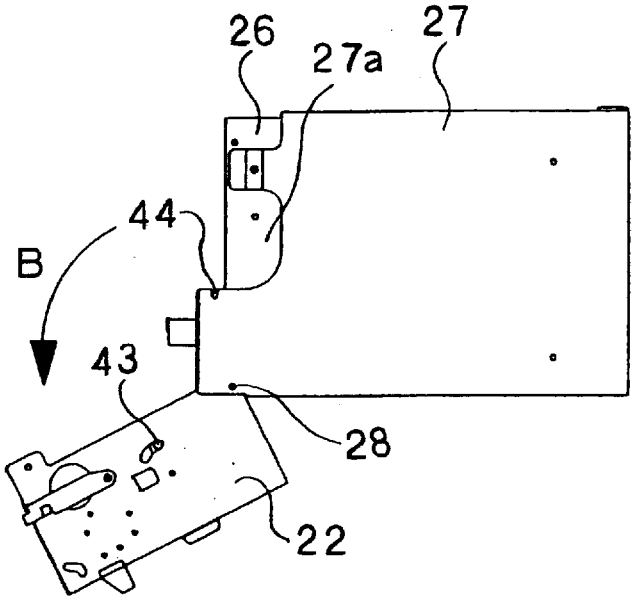
FIG. 15 is a side view of the bill dealing apparatus at the second step of bill collection.
Figure 16:
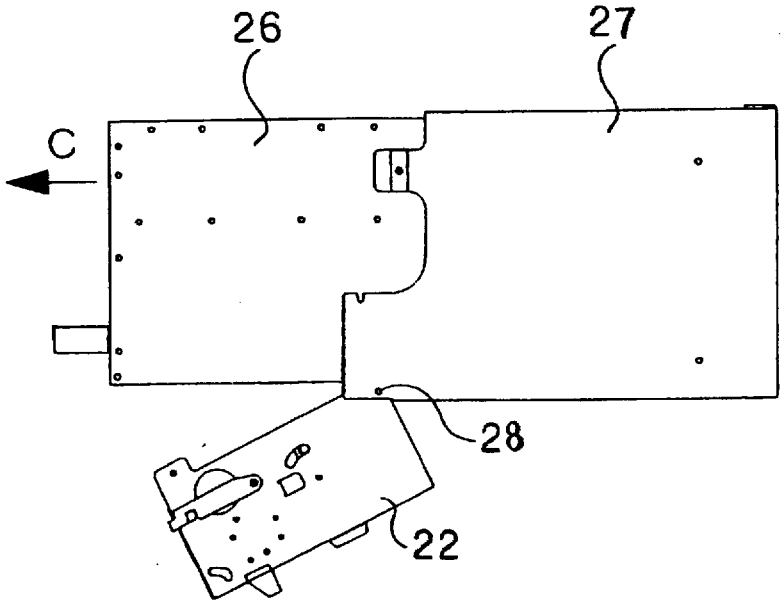
FIG. 16 is a side view of the bill dealing apparatus at the third step of bill collection.
Figure 17:
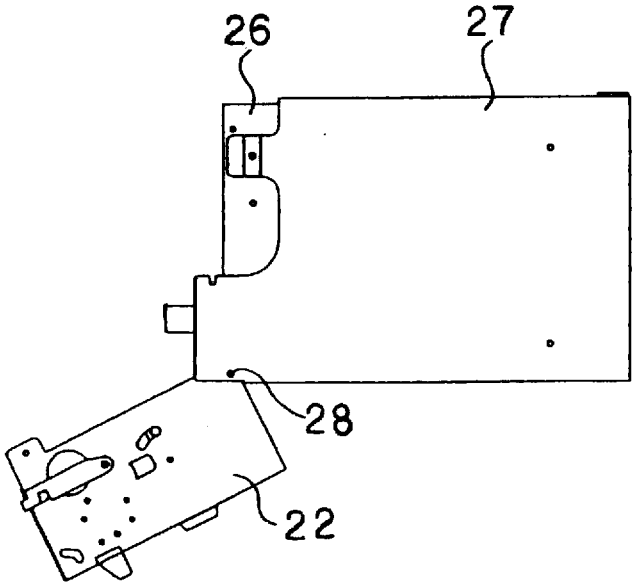
FIG. 17 is a side view of the bill dealing apparatus at the fourth step of bill collection.

FIG. 14 is a side view of the bill dealing apparatus 21 when it is built in a game machine. To play games, the bill is inserted into the bill insert opening 41 in the direction A. When the stacker 26 is collected, the key is inserted and turned in the key hole 42 provided on the front surface of the door 22 to unlock the door 22 and take off the rock stick 43 from the notch 44 of the body 27. By pulling the door 22 forward, the door 22 pivots in the direction B with respect to the support shaft 28 (FIG. 15). When the door 22 is open, the front face of the stacker 26 appears at the opening 27*a*. The front of the stacker 26 is pulled forward (in the direction C) to remove the stacker 26 from the body 27, as shown in FIG. 16. The stacker 26 is then transported to a secured place. The door 60 provided on the rear side of the stacker 26 is unlocked to collect the bills stored inside. When bill collecting is accomplished, the rear door 60 of the empty stacker 26 is closed and locked. The stacker 26 is then inserted into the body 27 built in the game machine, and is stored in the body 27 as it was, as shown in FIG. 17.

With the bill dealing apparatus 21 of the invention, the stacker 26 appears immediately at the opening 27*a* of the body 27 simply by unlocking and opening the door 22, and is easily taken out from the slot machine. This is in contrast to the conventional structure which requires many steps of actions for collecting the stacker 26, i.e., unlocking the bottom door 9, opening the bottom door 9, unlocking the bill stand 2, and operating the lever 10 and handle 11. In the stacker collection according to the embodiment, the stacker 26 is easily collected by simply unlocking and opening the small door 22. Because the bill validator 25 is attached to the inside the door 22 and the door 22 itself is exposed on the surface of the game machine, the bill dealing apparatus 21 which allows the stacker 26 to be simply taken out from the slot machine can be realized. This can save a labor of collecting stackers, while allowing the bill dealing apparatus 21 to be easily installed in the slot machine with an improved unit installation ability.

In the embodiment, the shaft 28 is provided at lower end of the opening 27*a* of the body 27, and the door 22 opens downward by pivoting about the shaft 28. However, the shaft 28 may be provided at upper end of the opening 27*a* of the body 27 to make the door 22 open upward pivoting about the upper end of the body 27. Although, in the embodiment, the door 22 has the key hole 42 and is locked or unlocked manually using the key, an automatic lock mechanism may be provided to the bill dealing apparatus 21. If this is a body, when a card key is inserted through the bill insertion opening 41, a card insertion signal is output from the bill validator 25 to the automatic lock mechanism to unlock the door 22. This structure can also achieve the same effect and advantage as that of the preferred embodiment.

Since the bill validator 25 is provided inside the door 22, the bill validator 25 and the stacker 26 are aligned with each other within the body 27 in the horizontal direction. Furthermore, the bill presser 31 is directly attached to the face of the inner wall of the stacker 26, thereby omitting attachment panel which was used in prior art to mount the bill presser 31. This can reduce the size (height) of the bill dealing apparatus 21, as well as the number of parts used therein. Consequently, the bill dealing apparatus 21 can be made compact while reducing the manufacturing cost. The stacker 26 and the driving unit 29 are made as separate units to remove heavy elements, such as the motor 47 and the deceleration mechanism, from the stacker 26. Both weight and size of the stacker 26 are reduced, and the labor of collecting and transporting many stackers 26 is lightened.

The bill 24 is supported at both edges thereof by linear contact with rails 61 provided on either side of the bill feeding path 62 to reduce the contact resistance between the inserted bill 24 and the bill feeding path 62. Even if the inserted bill 24 is wet or creased, the bill 24 is guided through the bill receiving port 49 with less resistance, transported smoothly along the bill feeding path 62, and is stored in the stacker 26.

Although the invention has been described with an application to the slot machine as a preferred embodiment, the invention is not limited to this. The bill dealing apparatus of the invention is applicable to other game machines, money changers, or vending machines without spoiling any effect or advantage of the preferred embodiment described above.

The scope of the invention is not limited by the description of the preferred embodiment. It is clear for those skilled in the art that various kinds of modifications can be made without departing from the sprit and scope of the invention, as clear from the following claims.

What is claimed is:

1. A bill dealing apparatus built in a machine, comprising: a bill validator for verifying the validity of bill inserted externally:

a bill feeding path for feeding the bill which has been determined as valid by the bill validator:

a bill stacker for storing the bill fed through the bill feeding path:

a body for removably receiving the bill stacker:

a bill presser for pushing the bill which has been fed from the bill validator into the bill stacker: and a driving source for driving the bill presser, wherein:

the body includes a door with a key, said door being which attached to the body in a pivotal manner and is exposed on the surface of the machine even when the bill dealing apparatus is built in the machine, and an opening which is closed by the door;

the bill stacker is removably inserted in the body through the opening; and the bill validator is integrally attached to the inside of the door.

2. The bill dealing apparatus according to claim 1, wherein:

the door is attached to the body to be pivotal around a supporting shaft provided on one of the lower and upper ends of the opening of the body.

3. The bill dealing apparatus according to claim 1, wherein:

the bill stacker is formed separating from the driving source, and attached to and detached from the body independently from the driving source.

4. The bill dealing apparatus according to claim 1, wherein:

the bill presser is attached to the face of an inner wall of the bill stacker.

5. The bill dealing apparatus according to claim 3, further comprising a motor wherein:

the driving source has a first gear provided on a torque a shaft, to which a torque of the motor is applied; and the bill stacker has a second gear which is engaged with the first gear, and a transmitting shaft for transmitting the torque applied to the second gear.

6. The bill dealing apparatus according to claim 5, wherein:

the bill presser is attached to the top inner wall of the bill stacker and presses the bill toward the bottom with torque transmitted to the shaft.

7. The bill dealing apparatus according to claim 6, wherein the bill presser comprises:

a disc positioned at one end of the transmission shaft which transmits the torque transmitted to the second gear;

an eccentric pin attached to the periphery of the disc;

an L-shaped slide plate consisting of a root plane attached to the bill presser and a standing plane having a slide groove extending horizontally near the edge of the plane to receive the eccentric pin; and a support frame attached to the top wall of the bill dealing apparatus and having a pair of grooves for receiving the side edges of the standing plane of the L-shaped slide plate slidable in the vertical direction.

8. The bill dealing apparatus according to claim 1, wherein:

the bill feeding path is composed of a pair of rails, each of which meets the edge of the bill to be fed.

9. The bill dealing apparatus according to claim 8, wherein:

the rails are composed of a pair of plate material attached to either inner side walls of the stacker; and one edge of the plate material is bent along the longitudinal axis into a U-shape to form a bill contact area.

10. The bill dealing apparatus according to claim 9, wherein:

the bill presser pushes the bill into the bill stacker via a pusher plate;

the distance between the pair of rails is set larger than the width of the pusher plate;

the bill stacker has a support plate for supporting the bill, the bill pushed by the pusher plate being supported between the support plate and the bottom edges of the U-shaped bend portion of the rails, and a compressive coil spring for forcing the support plate upward.

11. The bill dealing apparatus according to claim 10, wherein;

the pusher plate has a bend portion at one end on the bill receiving opening side to guide the inserted bill into the bill feeding path.

12. The bill dealing apparatus according to claim 10, wherein:

each of the support plate and the pusher plate has a notch on the edge to partially expose the bill.

13. The bill dealing apparatus according to claim 1, wherein:

the bill stacker has a recess or protrusion in the vicinity of the bill receiving opening and extending along the bill receiving opening; and the bill validator has a protrusion or recess, which is to be engaged with the recess or protrusion of the bill stacker, near the bill output port.

14. The bill dealing apparatus according to claim 1, wherein:

the body has a spring on the top wall, the spring being formed by cutting out a portion of the top wall of the body.

15. The bill dealing apparatus according to claim 1, wherein:

the equipment or machine is a game machine.

* * * * *